US007978037B2

(12) United States Patent
Yamada et al.

(10) Patent No.: US 7,978,037 B2
(45) Date of Patent: Jul. 12, 2011

(54) SWITCH DEVICE

(75) Inventors: Tomio Yamada, Aichi (JP); Tatsumi Ide, Miyagi (JP); Yoshinori Ota, Miyagi (JP)

(73) Assignees: Kabushiki Kaisha Tokai Rika Denki Seisakusho, Aichi (JP); NEC TOKIN Corporation, Miyagi (JP)

( * ) Notice: Subject to any disclaimer, the term of this patent is extended or adjusted under 35 U.S.C. 154(b) by 228 days.

(21) Appl. No.: 12/368,717

(22) Filed: Feb. 10, 2009

(65) Prior Publication Data

US 2009/0201110 A1 Aug. 13, 2009

(30) Foreign Application Priority Data

Feb. 12, 2008 (JP) ..... 2008-030415

(51) Int. Cl.
*H01H 9/00* (2006.01)

(52) U.S. Cl. ..... 335/205; 335/207; 335/302

(58) Field of Classification Search ..... 335/205–207, 335/302–306, 153; 338/32 R, 32 H; 324/207.11, 324/207.26; 200/61.89–61.9

See application file for complete search history.

(56) References Cited

U.S. PATENT DOCUMENTS

| | | | | |
|---|---|---|---|---|
| 3,984,797 | A * | 10/1976 | Rayburn | 335/306 |
| 4,596,971 | A * | 6/1986 | Hirabayashi et al. | 335/205 |
| 6,040,749 | A * | 3/2000 | Youngner et al. | 335/78 |
| 2004/0025949 | A1 * | 2/2004 | Wygnaski | 137/624.18 |
| 2009/0072936 | A1 * | 3/2009 | Yamada et al. | 335/207 |
| 2009/0091408 | A1 * | 4/2009 | Yamada et al. | 335/205 |

FOREIGN PATENT DOCUMENTS

JP 2005-235632 9/2005

* cited by examiner

*Primary Examiner* — Lincoln Donovan
*Assistant Examiner* — Bernard Rojas
(74) *Attorney, Agent, or Firm* — Morgan, Lewis & Bockius LLP

(57) ABSTRACT

A movable contact positioned in a sealed case is moved together with a movable contact spring provided with an armature by a magnetic shunt body which is moved outside the sealed case. The movement of the movable contact (movement of the movable contact spring) due to the movement of the magnetic shunt body is based on the change of the magnetically attracting force of a magnet with respect to the armature through a pair of yokes. The movable contact spring is provided with a bent portion which is bent in spaced-apart relation to the armature, the bent portion being provided between a fulcrum portion at a time when the movable contact spring moves and a portion where the armature is provided.

3 Claims, 4 Drawing Sheets

SWITCH DEVICE

BACKGROUND OF THE INVENTION

The present invention relates to a switch device in which an operating structure of a contact is improved.

Generally, a switch device is generally used in which a rod-like moving element is provided by being passed through a case in which a fixed contact, a movable contact, and a spring for normally bringing the movable contact into contact with or moving it away from the fixed contact are accommodated, and as the moving element is movably operated, the movable contact is moved relative to the fixed contact so as to be moved away from or into contact with the fixed contact (e.g., refer to JP-A-2005-235632).

The switch device having the above-described configuration is used as, for instance, a stop lamp switch for a vehicle, and lubricating oil applied to various mechanical portions and inorganic or organic substances contained in the product are present in the vicinities of that stop lamp switch for a vehicle. Meanwhile, with the above-described conventional switch device, there has been a possibility that foreign objects including the lubricating oil and inorganic and organic substances enter the interior of the case from the portion where the moving element is inserted and are adhered between the movable contact and the fixed contact, causing the problem of faulty conduction between the contacts due to a silicone component, in particular.

SUMMARY OF THE INVENTION

The invention has been devised in view of the above-described circumstances, and its object is to provide a switch device which can be realized with a structure which allows the fixed contact and the movable contact to be moved into contact with or away from each other while preventing the ingress of foreign objects such as lubricating oil into the case accommodating the fixed contact and the movable contact, which is capable of effecting more speedily the movement of the both contacts into contact with or away from each other to improve the switching performance, and which is capable of minimizing the sliding contact of related parts producing wear dust harmful to the contact between the fixed contact and the movable contact.

To attain the above object, in accordance with an aspect of the invention there is provided a switch device comprising: a fixed contact; a movable contact corresponding to the fixed contact; a movable contact spring on which the movable contact is provided and which is provided with an armature having a magnetic property; a sealed case accommodating the fixed contact, the movable contact, the armature, and the movable contact spring; a yoke having a magnetic property and corresponding to the armature; a magnet for attracting the armature through the yoke by applying a magnetic force to the yoke; a moving element which is positioned on an outer side of the sealed case and is movably operated; and a magnetic shunt body which is moved by the moving element, wherein an attracting force of the magnet with respect to the armature through the yoke is changed by changing a distance between the magnetic shunt body and the yoke by the movement of the magnetic shunt body, so as to move the movable contact together with the movable contact spring with respect to the fixed contact, and wherein the movable contact spring is provided with a bent portion which is bent in spaced-apart relation to the armature, the bent portion being provided between a fulcrum portion at a time when the movable contact spring moves with respect to the fixed contact and a portion where the armature is provided.

According to the above-described aspect of the invention, the movable contact positioned in the sealed case can be moved together with the movable contact spring with respect to the fixed contact by the movement of the magnetic shunt body which moves outside the sealed case. Hence, the movement of the movable contact and the fixed contact, which are accommodated in the sealed case, into contact with and away from each other can be effected without the ingress into the interior of the sealed case of foreign objects including lubricating oil and inorganic and organic substances which are present in the vicinities of the sealed case. Thus, it is possible to eliminate the possibility of causing the conventional problem of faulty conduction between the contacts due to the entrants.

In addition, the movement of the movable contact (movement into contact with or away from the fixed contact) due to the movement of the magnetic shunt body is based on the change of the magnetically attracting force of the magnet with respect to the armature through the pair of yokes, and its change is steep. Hence, the movement of the movable contact and the fixed contact into contact with and away from each other can be effected more speedily, thereby making it possible to improve the switching performance.

In addition, since the configuration provided is such that the movable contact spring is provided with a bent portion which is bent in spaced-apart relation to the armature, the bent portion being provided between a fulcrum portion at a time when the movable contact spring moves with respect to the fixed contact and a portion where the armature is provided, it is possible to alleviate the sliding of the armature and the yoke. This makes it possible to minimize the production of wear dust which is harmful to the contact between the fixed contact and the movable contact.

DETAILED DESCRIPTION OF PREFERRED EMBODIMENTS

Hereafter, by applying the invention to a stop lamp switch for a vehicle, a description will be given of its first embodiment with reference to FIGS. 1 to 3.

Figure 1:
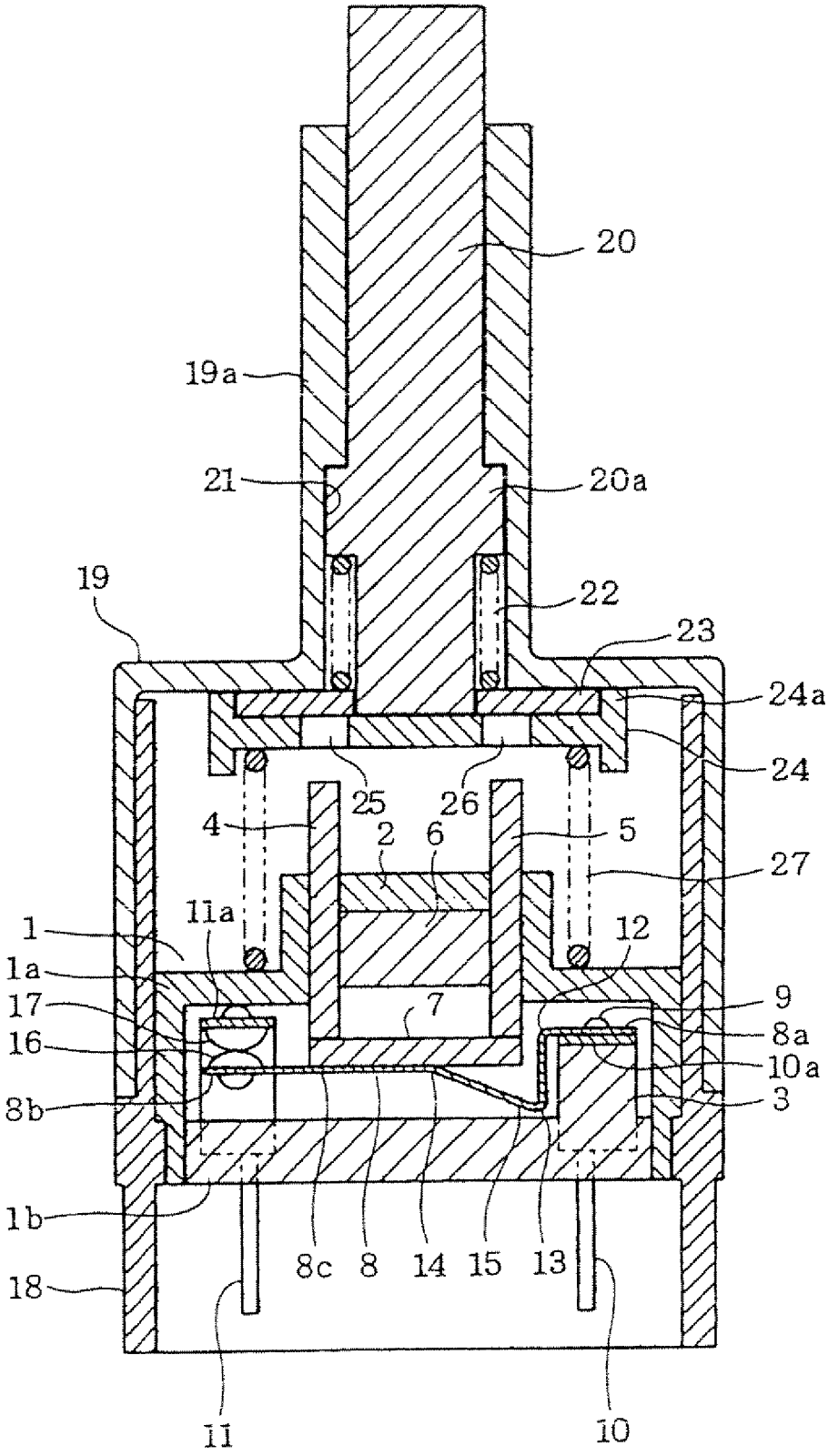
FIG. 1 is a vertical cross-sectional view illustrating a first embodiment of the invention.

First, FIG. 1 shows an overall configuration of the stop lamp switch for a vehicle, and a sealed case 1 is its main body. This sealed case 1 is comprised of a case main body portion 1*a* and a case base portion 1*b*, and the case main body portion 1*a* of these has a cap shape in which an upper surface portion is closed by having a protruding portion 2 in its central portion and a bottom is open. The case base portion 1*b* has a flat shape except that a projecting portion 3 is provided on an upper surface of a right-hand portion in the drawing.

A pair of yokes 4 and 5 are provided in such a manner as to be passed through the protruding portion 2 of the aforementioned case main body portion 1*a*. These yokes 4 and 5 are both formed of a magnetic material such as iron. As these yokes 4 and 5 are provided by being inserted during, for instance, the molding of the case main body portion 1*a*, these yokes 4 and 5 are integrated with the case main body portion 1*a*. The integrated form is maintained as respective intermediate portions of the yokes 4 and 5 are adhered tightly with the protruding portion 2 of the case main body portion 1*a* to thereby ensure that permeability will not be provided between the two upper and lower spaces partitioned by the case main body portion 1*a*. The respective upper portions of the yokes 4 and 5 project therefrom to outside the case main body portion 1*a*, i.e., into the space above the protruding portion 2 of the case main body portion 1*a*, while the respective lower portions thereof project into the interior of the case main body portion 1*a*, i.e., into the space below the protruding portion 2 of the case main body portion 1*a*.

In addition, a magnet permanent magnet) 6 is provided within the protruding portion 2 of the case main body portion 1*a* by being located between the yokes 4 and 5. This magnet 6 is also integrated with the case main body portion 1*a* by being provided by being inserted during, for instance, the molding of the case main body portion 1*a*. The integrated form is such that the upper portion of the magnet 6 is located within the protruding portion 2 of the case main body portion 1*a*, both side surfaces thereof are in contact with the yokes 4 and 5, and the lower surface thereof is exposed to the interior of the case main body portion 1*a*.

The yokes 4 and 5 are juxtaposed on the left and right in the drawing, and a movable contact spring 8 having an armature 7 is disposed at a position immediately therebelow. The armature 7 is formed of a magnetic material such as iron, has a flat plate shape. In contrast, the movable contact spring 8 is formed of an electrically conductive leaf spring material of phosphor bronze or the like which is a nonmagnetic material, and the armature 7 is secured on the upper surface thereof.

As for the movable contact spring 8, its one end portion 8*a* on the right-hand side in the drawing is also secured to the projecting portion 3 of the case base portion 1*b* through an upper end portion 10*a* of a connection terminal 10 by a rivet 9. The connection terminal 10, together with another connection terminal 11, is provided in a state of being passed through the case base portion 1*b*. Specifically, as these connection terminals 10 and 11 are also provided by being inserted during the molding of the case base portion 1*b*, these connection terminals 10 and 11 are integrated with the case base portion 1*b*. The integrated form is maintained as respective intermediate portions of the connection terminals 10 and 11 are adhered tightly with the case base portion 1*b* to thereby ensure that permeability will not be provided between the two upper and lower spaces partitioned by the case base portion 1*b*. The respective upper portions of the connection terminals 10 and 11 project therefrom above the case base portion 1*b*, while the respective lower portions thereof project below the case base portion 1*b*.

It should be noted that, as for the integration of the connection terminals 10 and 11 with the aforementioned case base portion 1*b*, a structure may be adopted in which after drilling a pair of holes in the case base portion 1*b*, the connection terminals 10 and 11 are respectively passed through these holes, and a gap between each hole and each connection terminal 10, 11 is filled by a sealant to hermetically seal the respective gap. In addition, this structure can also be applied to portions where the yokes 4 and 5 are integrated with the aforementioned case main body portion 1*a*. Namely, a structure may be adopted in which after drilling a pair of holes in the case main body portion 1*a*, the yokes 4 and 5 are respectively passed through these holes, and a gap between each hole and each yoke 4, 5 is filled by a sealant to hermetically seal the respective gap.

Here, the upper end portion 10*a* of the connection terminal 10 with the one end portion 8*a* of the aforementioned movable contact spring 8 secured thereto is bent in an L-shape and is located on an upper surface of the aforementioned projecting portion 3 of the case base portion 1*b*. Accordingly, the one end portion 8*a* of the aforementioned movable contact spring 8 is also located on an upper surface of that projecting portion 3 via the upper end portion 10*a* of the connection terminal 10.

Further, the movable contact spring 8 is bent in a substantially L-shape (first bent portion 12) from the aforementioned one end portion 8*a* in parallel with an inner side surface of the projecting portion 3. The movable contact spring 8 is then bent in a substantially V-shape (second bent portion 13) so as to be directed from a vicinity of the case base portion 1*b* toward the gap between the yokes 4 and 5 (particularly toward a central portion of the gap). Further, the movable contact spring 8 is bent in a substantially chevron-shape (third bent portion 14) in a direction opposite to that of the second bent portion 13, i.e., toward the case base portion 1*b* in a normal state, as shown in FIG. 2. A portion of the aforementioned armature 7 between one end and the substantially central portion is secured by the portion ranging from that third bent portion 14 to an intermediate portion 8*c* on the other end portion 8*b* side.

Accordingly, the movable contact spring 8 in its portion ranging from the first bent portion 12 to the portion where the armature 7 is provided has a bent portion 15 which is bent in spaced-apart relation to the armature 7 and is substantially V-shaped in this case. In addition, a movable contact 16 is provided on the upper surface of the other end portion 8*b* of the movable contact spring 8.

The case base portion 1*b* is joined to the bottom of the case main body portion 1*a* and tightly closes the open portion at that bottom. In this state, the movable contact spring 8 causes the right end portion in the drawing of the armature 7 to abut against a lower end of the right-side yoke 5, and causes the left end portion thereof in the drawing to be spaced apart downward from the left-side yoke 4 in the normal state (FIG. 2).

In contrast, in the state shown in FIG. 1 in which the magnetic force of the aforementioned magnet 6 is applied to the armature 7 through the yokes 4 and 5, the armature 7 is attracted to the magnet 6 by means of the yokes 4 and 5, so that the movable contact spring 8 is resiliently deformed in a state in which the aforementioned intermediate portion 8*c* is set substantially horizontally.

Meanwhile, a fixed contact 17 is disposed above the movable contact 16. Specifically, this fixed contact 17 is provided on a lower surface of an upper end portion 11*a*, bent in an L-shape, of the aforementioned connection terminal 11 and opposes the movable contact 16, such that the movable contact 16 is in contact within the fixed contact 17 in the state in which the armature 7 is attracted to the magnet 6 and the movable contact spring 8 is resiliently deformed, as described above.

As already described, the case base portion 1*b* is joined to the bottom of the case main body portion 1*a* to thereby constitute the above-described sealed case 1, and has a structure in which the fixed contact 17, the movable contact 16, the armature 7, the movable contact spring 8, the magnet 6, lower portions of the yokes 4 and 5, and the respective upper end portions 10*a* and 11*a* of the connection terminals 10 and 11 are accommodated in the interior of that sealed case 1.

It should be noted that the respective lower end portions of the connection terminals 10 and 11 projecting downward from the case base portion 1*b* are surrounded by a sleeve 18 surrounding the sealed case 1, and unillustrated conductive wires are adapted to be connected to the lower end portions of the connection terminals 10 and 11 via an unillustrated connector which is inserted in the interior of the sleeve 18.

Further, a cover 19 is fitted on the outer side of the sleeve 18, and this cover 19, which shaped in the form of a cap, has a guide tube 19*a* in a central portion of its upper portion. A rod-like moving element 20 is inserted in this guide tube 19*a* so as to be movable vertically in the drawing. The moving element 20 has a large-diameter portion 20*a* in an intermediate portion close to a lower end portion thereof, and this large-diameter portion 20*a* is inserted in a large-diameter hole portion 21 formed in a lower portion of the guide tube 19*a*.

In addition, a first spring 22 is loaded on a portion lower than the large-diameter portion 20*a* of the moving element 20. This first spring 22 is a compression coil spring which surrounds the large-diameter portion 20*a* of the moving element 20, and this first spring 22 is also accommodated in the large-diameter hole portion 21 of the aforementioned guide tube 19*a*. Further, a magnetic shunt body 23 is assembled to a lower end portion of the moving element 20. This magnetic shunt body 23 is formed of a magnetic material such as iron and has an annular shape surrounding the moving element 20, and its outside diameter is larger than that of the lower end portion of the guide tube 19*a*.

Furthermore, a holder 24 is disposed immediately below the magnetic shunt body 23. This holder 24 is even larger in diameter than the magnetic shunt body 23, and has on its outer peripheral portion a rim 24*a* projecting in both upper and lower directions. In addition, holes 25 and 26 are formed in this holder 24 at portions closer to its center from its outer peripheral portion in correspondence with the aforementioned yokes 4 and 5.

Further, a second spring 27 is interposed between a lower surface of the holder 24 and the case main body portion 1*a* of the sealed case 1. This second spring 27 is a compression coil spring which surrounds the protruding portion 2 of the case main body portion 1*a*, and pushes up the moving element 20 and the magnetic shunt body 23 from the holder 24 with an urging force stronger than that of the first spring 22, i.e., urges them toward an opposite side to the side of the yokes 4 and 5. In addition, as a result, the holder 24 spaces the magnetic shunt body 23 apart upward from the upper ends of the yokes 4 and 5 so as to be pressed against the lower end moving element 20 and to surround the magnetic shunt body 23 by the upwardly projecting portion of the rim 24*a*.

Furthermore, the moving element 20 is pushed upward until its large-diameter portion 20*a* is restricted by an innermost end of the large-diameter hole portion 21 of the guide tube 19*a*, such that its upper portion projects upward from the guide tube 19*a* and corresponds to an unillustrated brake pedal of the vehicle.

Meanwhile, the first spring 22 presses the magnetic shunt body 23 against the holder 24, i.e., urges the magnetic shunt body 23 in the moving direction toward the side of the yokes 4 and 5, thereby allowing the magnetic shunt body 23 to be retained and held at the position shown in FIG. 1.

Next, a description will be given of the operation of the stop lamp switch for a vehicle having the above-described configuration.

Before performing the stepping operation of the stop lamp switch for a vehicle, the stop lamp switch for a vehicle remains in the state shown in FIG. 1. Namely, the moving element 20 and the magnetic shunt body 23 remain pushed up from the holder 24 by the second spring 27, as described above, such that the magnetic shunt body 23 is held at a position spaced apart upward from the upper ends of the yokes 4 and 5, and the moving element 20 has its upper portion projecting upward from the guide tube 19*a*.

As a result, as the magnetic force of the magnet 6 is applied only to the armature 7 through the yokes 4 and 5, the armature 7 is attracted to the magnet 6, and in conjunction with it the movable contact spring 8 is resiliently deformed into the state in which its intermediate portion 8*c* is set substantially horizontally, bringing the movable contact 16 into contact with the fixed contact 17. Accordingly, at this time, the movable contact 16 and the fixed contact 17 allow the connection terminals 10 and 11 to conduct with each other by an electric path through the movable contact spring 8.

Figure 2:
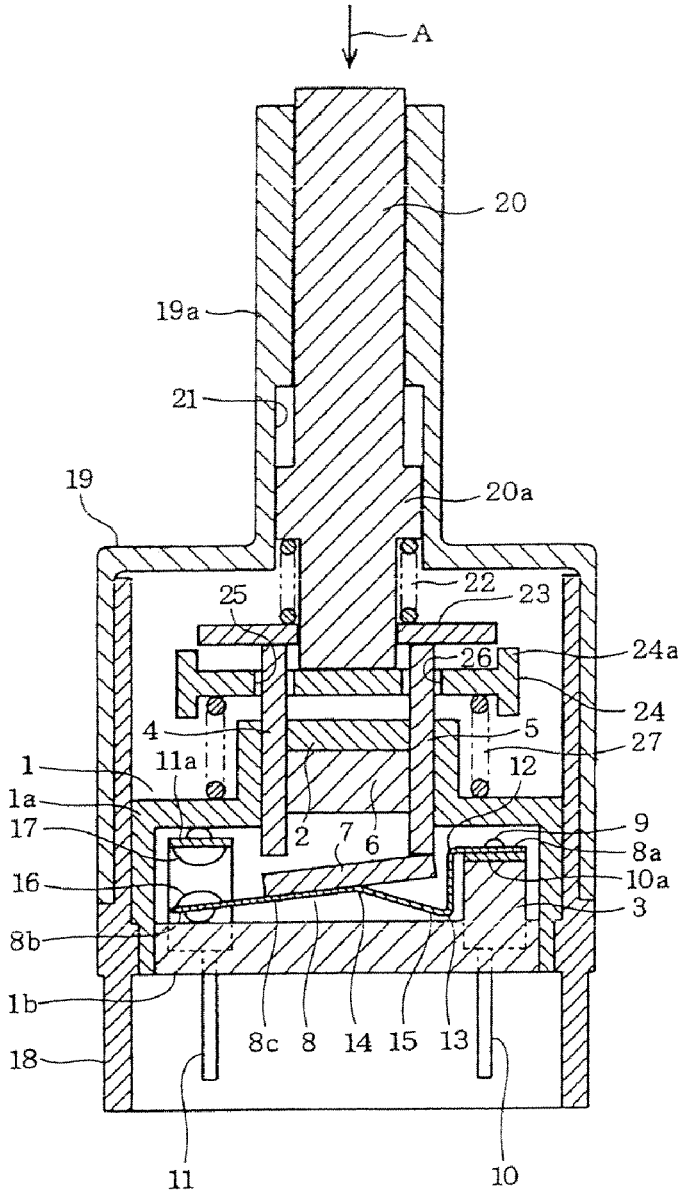
FIG. 2 is a vertical cross-sectional view in which the state is different from that of FIG. 1.
Figure 3:
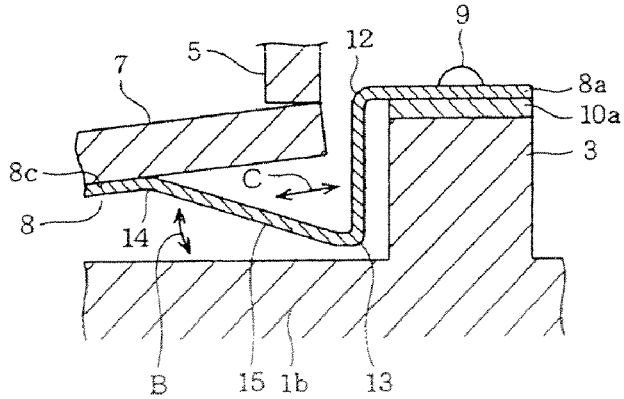
FIG. 3 is an enlarged vertical cross-sectional view of an essential portion.

In this state, if the pressing operation of the brake pedal of the vehicle is performed as shown by arrow A in FIG. 2, the moving element 20 correspondingly compresses the second spring 27 through the holder 24, and moves to the sealed case 1 side. Accordingly, the holder 24 and the magnetic shunt body 23 also move to the sealed case 1 side (side of the yokes 4 and 5), and the holder 24 allows the yokes 4 and 5 to be passed through the holes 25 and 26. As a result, the magnetic shunt body 23 is brought into contact with the upper ends of the yokes 4 and 5. It should be noted that this contact of the magnetic shunt body 23 with the upper ends of the yokes 4 and 5 is resiliently effected by being effected while compressing the first spring 22.

Then, when the magnetic shunt body 23 is brought into contact with the upper ends of the yokes 4 and 5, the magnetic force of the magnet 6 is applied not only to the armature 7 through the yokes 4 and 5 but also to the magnetic shunt body 23 through the yokes 4 and 5, so that the magnetic force applied to the armature 7 correspondingly changes (weakens in this case), and the attracting force with respect to the armature changes (weakens in this case). Hence, the restoring force of the movable contact spring 8 from the aforementioned resiliently deformed state overcomes the attracting force of the magnet 6 with respect to the armature 7, so that the movable contact spring 8 is restored and causes the movable contact 16 to be spaced apart from the fixed contact 17, thereby shutting off the electric path between the connection terminals 10 and 11. Thus, the stop lamp switch for a vehicle responds to the stepping operation of the brake pedal of the vehicle and hence lights up an unillustrated stop lamp for a vehicle.

Subsequently, if the stepping operation of the brake pedal of the vehicle is released, all return to the original state, namely, the armature 7 is attracted by the magnet 6, the movable contact spring 8 is resiliently deformed, and the movable contact 16 is brought into contact with the fixed contact 17 to thereby turn off the stop lamp for a vehicle.

In addition, when the movable contact 16 is moved into contact with or away from the fixed contact 17, the one end portion, on the right-hand side in the drawing, of the armature 7 is brought into sliding contact with the yoke 5. If the degree of this sliding contact is strong, problems of faulty operation result in such as that the movement of the armature 7 lacks smoothness, the movement of the movable contact 16, when moved into contact with or away from the fixed contact 17, becomes unstable, and wear dust caused in the sliding contact is produced in a large amount, causing damage to the contact between the fixed contact 17 and the movable contact 16.

In contrast, in the stop lamp switch for a vehicle in accordance with this configuration, since the movable contact spring 8 moves with the first bent portion 12 as a fulcrum portion, the bent portion 15 which is bent in spaced-apart relation to the armature 7 is provided between that fulcrum portion (first bent portion 12) and the portion where the armature 7 is provided. As shown in FIG. 3, with respect to the movement (arrow B) of the movable contact spring 8 from the fulcrum portion, this bent portion 15 has flexibility in a direction (arrow C) perpendicular thereto. By virtue of this flexibility, the degree of the sliding contact of the one end portion, located on the right side in the drawing, of the armature 7 with respect to the yoke 5 is weakened, and the movement of the armature 7 becomes smooth. As such, in the stop lamp switch for a vehicle in accordance with this configuration, the movement of the movable contact 16 into contact with or away from the fixed contact 17 becomes stable, wear dust caused in the sliding contact is not produced in a large amount, and it is possible to prevent the occurrence of such problems of faulty operation as to cause damage to the contact between the fixed contact 17 and the movable contact 16.

Thus, in the stop lamp switch for a vehicle in accordance with this configuration, as the magnetically attracting force of the magnet 6 which is applied to the armature 7 in the sealed case 1 through the yokes 4 and 5 changes due to the movement of the magnetic shunt body 23 caused by the movement of the moving element 20 outside the sealed case 1, the movable contact 6 together with the movable contact spring 8 can be moved with respect to the fixed contact 17 without being made to enter the interior of the sealed case 1. Hence, the movement the movable contact 16 and the fixed contact 17, which are accommodated in the sealed case 1, into contact with and away from each other can be effected without the ingress into the interior of the sealed case 1 of foreign objects including lubricating oil and inorganic and organic substances which are present in the vicinities of the sealed case 1. Thus, it is possible to eliminate the possibility of causing the conventional problem of faulty conduction between the contacts 16 and 17 due to the entrants.

In addition, the change of the magnetically attracting force of the magnet 6 with respect to the armature 7 and hence the movable contact 16 in the sealed case 1 through the yokes 4 and 5 owing to the movement of the magnetic shunt body 23 can be made steeper than in the case where the magnet 6 itself is moved. Hence, the movement of the movable contact 16 and the fixed contact 17 into contact with and away from each other can be effected more speedily, thereby making it possible to improve the switching performance.

In addition, since the bent portion 15 which is bent in spaced-apart relation to the armature 7 is provided between the fulcrum portion (first bent portion 12) at the time when the movable contact spring 8 moves with respect to the fixed contact 17 and the portion where the armature 7 is provided, it is possible to alleviate the sliding contact of the armature 7 with respect to the yoke 5. This also makes it possible to stabilize the movement of the movable contact 16 into contact with and away from the fixed contact 17 and prevent the occurrence of such problems of faulty operation as to cause damage to the contact between the fixed contact 17 and the movable contact 15.

Figure 4:
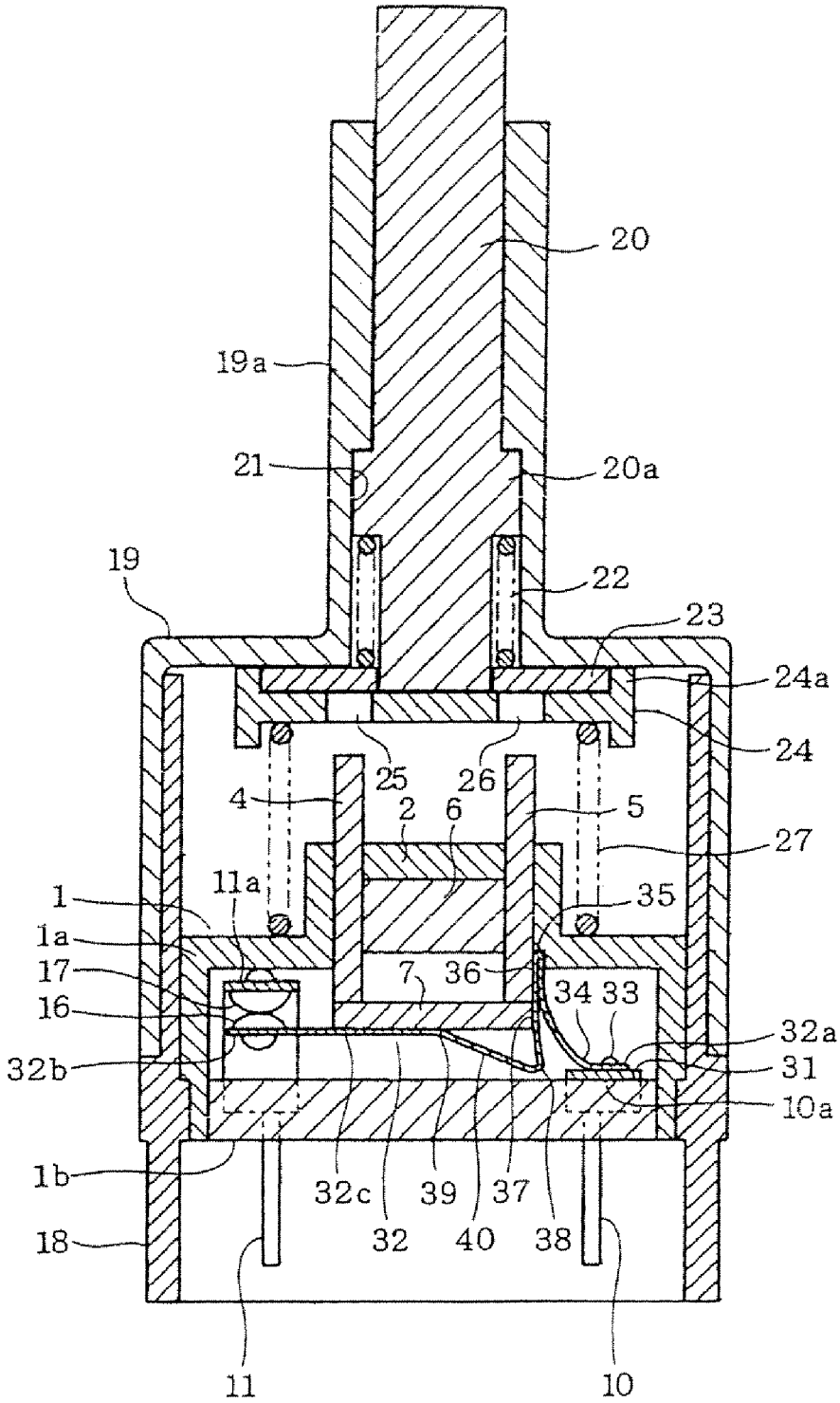
FIG. 4 is a vertical cross-sectional view illustrating a second embodiment of the invention.
Figure 5:
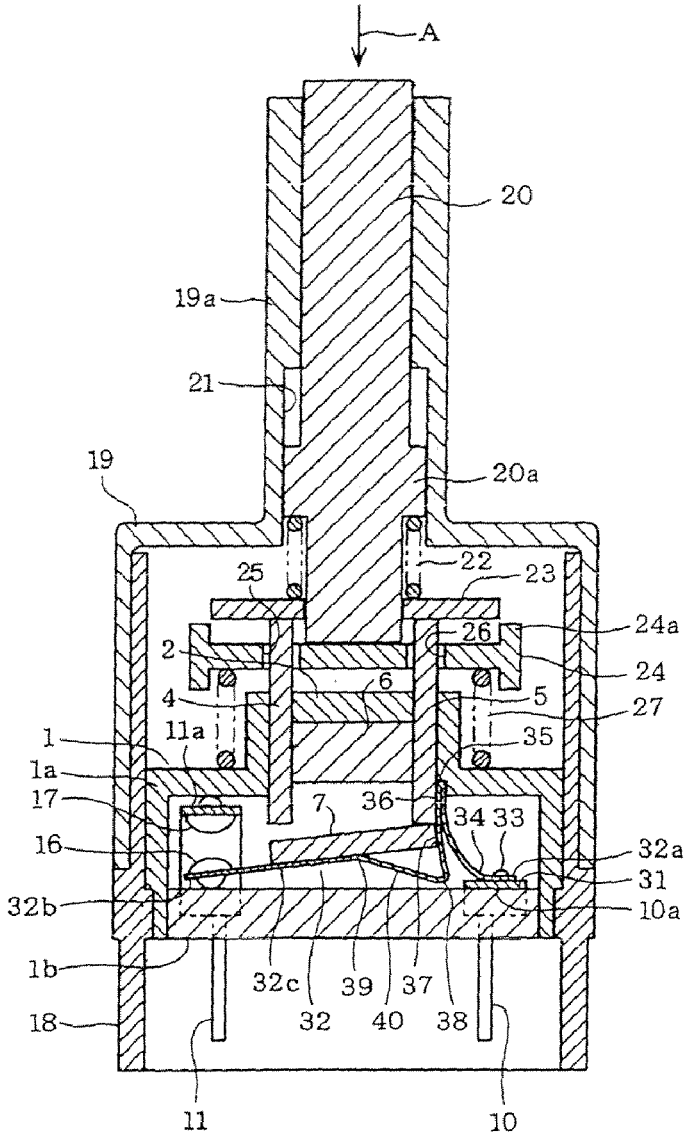
FIG. 5 is a diagram corresponding to FIG. 2.
Figure 6:
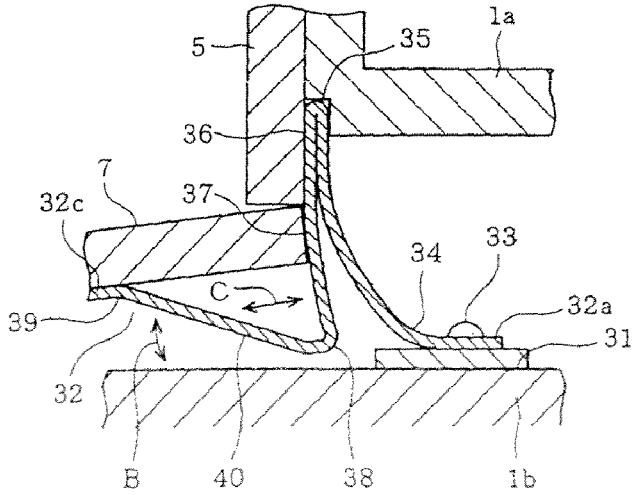
FIG. 6 is a diagram corresponding to FIG. 3.

On the other hand, FIGS. 4 to 6 show a second embodiment of the invention, in which identical portions to those of the first embodiment will be denoted by the same reference numerals, a description thereof will be omitted, and a description will be given of only different portions.

In the case of this stop lamp switch for a vehicle, the above-described projecting portion 3 is not provided on the case base portion 1*b*, a flat portion 31 is formed there, and one end portion 32*a* of a movable contact spring 32, which is substituted for the above-described movable contact spring 8, is secured to that flat portion 31 via the upper end portion 10*a* of the connection terminal 10 by a rivet 33.

Specifically, the movable contact spring 32 is bent upward in an arcuate shape (first bent portion 34) from one end portion 31*a*, is then bent in a substantially inverse U-shape (second bent portion 35) at that upper portion, and a portion 36 in the vicinity thereof is secured to the lower end portion of the yoke 5, whereas a part 37 of the movable contact spring 32 is only abutted against the armature 7. The movable contact spring 32 is then bent in a substantially V-shape third bent portion 38) so as to be directed from a vicinity of the case base portion 1*b* therebelow toward the gap between the yokes 4 and 5 particularly toward a central portion of the gap). Further, the movable contact spring 32 is bent in a substantially chevron-shape (fourth bent portion 39) in a direction opposite to that of the third bent portion 38, i.e., toward the case base portion 1*b* in the normal state, as shown in FIG. 5, to secure the armature 7 up to its substantially central portion by the portion ranging from that fourth bent portion 39 to an intermediate portion 32*c* on the other end portion 32*b* side.

Accordingly, the movable contact spring 32 in its portion ranging from the second bent portion 35 to the portion where the armature 7 is provided has a bent portion 40 which is bent in spaced-apart relation to the armature 7 and is substantially V-shaped in this case. In addition, the above-described movable contact 16 is provided on the upper surface of the other end portion 32*b* of the movable contact spring 32.

In this configuration as well, when the movable contact 16 is moved into contact with or away from the fixed contact 17 on the basis of the stepping operation of the brake pedal of the vehicle and its release (movement of the magnetic shunt body 23 into contact with or away from the yoke 5), the movable contact spring 8 moves with the second bent portion 35 as a fulcrum portion, and the bent portion 40 which is bent in spaced-apart relation to the armature 7 is provided in the movable contact spring 32 between that fulcrum portion (second bent portion 35) and the portion where the armature 7 is provided. As shown in FIG. 6, with respect to the movement (arrow B) of the movable contact spring 8 from the fulcrum portion, this bent portion 40 has flexibility in a direction (arrow C) perpendicular thereto. By virtue of this flexibility, the degree of the sliding contact of the one end portion, located on the right side in the drawing, of the armature 7 with respect to the yoke 5 is weakened, and the movement of the armature 7 becomes smooth. As such, in the stop lamp switch for a vehicle in accordance with this configuration as well, the movement of the movable contact 16 into contact with or away from the fixed contact 17 becomes stable, wear dust caused in the sliding contact is not produced in a large amount, and it is possible to prevent the occurrence of such problems of faulty operation as to cause damage to the contact between the fixed contact 17 and the movable contact 16.

In addition, the movement of the fixed contact 17 and the movable contact 16 into contact or away from each other can be effected in a state in which the ingress of foreign objects such as lubricating oil into the interior of the sealed case 1 accommodating the fixed contact 17 and the movable contact 16 is prevented. Moreover, the movement of the movable contact 16 and the fixed contact 17 into contact with and away from each other can be effected more speedily, and the effect of improving the switching performance can be obtained in the same way as in the first embodiment.

It should be noted that the invention is not limited to the embodiments described above and illustrated in the drawings. In particular, the magnetic shunt body which moves in conjunction with the movement of the moving element may be one which is not brought into contact with the yoke but sufficiently approaches it. In other words, the magnetic shunt body is sufficient the distance between the magnetic shunt body and the yoke can be changed.

In addition, a change may be made between the fixed contact and the movable contact such that the movable contact is spaced apart from the fixed contact before the stepping operation of the brake pedal of the vehicle, and the movable contact is brought into contact with the fixed contact in correspondence with the stepping operation of the brake pedal of the vehicle.

Furthermore, the movable contact spring and the armature may be integrally formed of not the two members of an electrically conductive spring material (nonmagnetic material) and a magnetic material but one member of an electrically conductive spring material having a magnetic property. If such an arrangement is particularly adopted, there is an advantage of making it possible to reduce the number of component parts used.

In addition, the invention can be generally applied to switch devices which are used in similar circumstances, and can be implemented by making appropriate changes and modifications without departing from the scope of the invention.

What is claimed is:

1. A switch device comprising:

a fixed contact;

a movable contact corresponding to the fixed contact;

a movable contact spring on which the movable contact is provided and which is provided with an armature having a magnetic property;

a sealed case accommodating the fixed contact, the movable contact, the armature, and the movable contact spring;

yokes having a magnetic property and corresponding to the armature;

a magnet for attracting the armature through the yokes by applying a magnetic force to the yokes;

a moving element which is positioned on an outer side of the sealed case and is movably operated; and a magnetic shunt body which is moved by the moving element, wherein an attracting force of the magnet with respect to the armature through the yokes is changed by changing a distance between the magnetic shunt body and the yoke by movement of the magnetic shunt body, so as to move the movable contact together with the movable contact spring with respect to the fixed contact, and wherein the movable contact spring is provided with a bent portion which is bent in spaced-apart relation to the armature, the bent portion being provided between a fulcrum portion at a time when the movable contact spring moves with resect to the fixed contact and a portion where the armature is provided.

2. The switch device according to claim 1, wherein one end portion of the movable contact spring is located on a projecting portion formed on the sealed case, the bent portion includes a first bent portion bent in substantially L-shape from the one end portion in parallel with an inner side surface of the projecting portion, a second bent portion bent in substantially V-shape so as to directed toward a gap between the yokes, and a third bent portion bent in a substantially chevron-shape in a direction opposite to that of the second bent portion.

3. The switch device according to claim 1, wherein the bent portion includes a first bent portion bent upward in an arcuate shape from one end portion of the movable contact spring, a second bent portion bent in a substantially inverse U-shape, a third bent portion bent in a substantially V-shape so as to be directed toward a gap between the yokes, and a fourth bent portion bent in substantially chevron-shape in a direction opposite to that of the third bent portion.

* * * * *